US010525995B2

(12) United States Patent
Widlroither

(10) Patent No.: US 10,525,995 B2
(45) Date of Patent: Jan. 7, 2020

(54) SAFEGUARDING SYSTEM FOR AN EMERGENCY FISH-PLATE CONNECTOR

(71) Applicant: ROBEL BAHNBAUMASCHINEN GMBH, Freilassing (DE)

(72) Inventor: Otto Widlroither, Freilassing (DE)

(73) Assignee: Robel Bahnbaumaschinen GmbH, Freilassing (DE)

( * ) Notice: Subject to any disclaimer, the term of this patent is extended or adjusted under 35 U.S.C. 154(b) by 164 days.

(21) Appl. No.: 15/737,775

(22) PCT Filed: Jun. 24, 2016

(86) PCT No.: PCT/EP2016/001082
§ 371 (c)(1),
(2) Date: Dec. 19, 2017

(87) PCT Pub. No.: WO2017/016627
PCT Pub. Date: Feb. 2, 2017

(65) Prior Publication Data

US 2019/0002003 A1 Jan. 3, 2019

(30) Foreign Application Priority Data

Jul. 24, 2015 (DE) ..... 20 2015 005 277 U

(51) Int. Cl.
*B61L 27/00* (2006.01)
*E01B 11/18* (2006.01)
(Continued)

(52) U.S. Cl.
CPC ..... *B61L 27/0088* (2013.01); *B61L 1/20* (2013.01); *B61L 23/044* (2013.01); *E01B 11/18* (2013.01); *E01B 11/36* (2013.01)

(58) Field of Classification Search
CPC ..... B61L 27/0088; B61L 1/20; B61L 23/044; E01B 11/18; E01B 11/20; E01B 11/22; E01B 11/26; E01B 11/36
See application file for complete search history.

(56) References Cited

U.S. PATENT DOCUMENTS 3,552,647 A * 1/1971 Plasser ..... E01B 11/18 238/243
3,593,918 A * 7/1971 Borst ..... E01B 11/18 238/91

(Continued)

FOREIGN PATENT DOCUMENTS

AU 2004293547 B2 6/2005
CN 103541283 A 1/2014

(Continued)

*Primary Examiner* — Jason C Smith
(74) *Attorney, Agent, or Firm* — Laurence A. Greenberg; Werner H. Stemer; Ralph E. Locher

(57) ABSTRACT

A safeguarding system for an emergency fish-plate connector is fastened to a rail base of the rail and has a distance measuring device for supplying a measuring value registering a distance a between the emergency fish-plate connector and the safeguarding system. For transmission of the detected measuring values and of an identifying signal—enabling a locally unambiguous correlation of the emergency fish-plate connector with regard to the track—to a control station, the safeguarding system is equipped with a radio device.

2 Claims, 1 Drawing Sheet

(51) Int. Cl.

| | |
|---|---|
| ***B61L 1/20*** | (2006.01) |
| ***E01B 11/36*** | (2006.01) |
| ***B61L 23/04*** | (2006.01) |

(56) References Cited

U.S. PATENT DOCUMENTS

| | | | | | |
|---|---|---|---|---|---|
| 3,682,383 | A * | 8/1972 | Borst | E01B 11/18 | 238/171 |
| 5,791,559 | A * | 8/1998 | Fox | E01B 11/38 | 238/218 |
| 5,927,600 | A * | 7/1999 | Collin | E01B 11/20 | 238/218 |
| 2018/0215400 | A1* | 8/2018 | Agrawal | B61L 15/0027 | |
| 2018/0291562 | A1* | 10/2018 | Yu | E01B 11/26 | |
| 2019/0002003 | A1* | 1/2019 | Widlroither | B61L 1/20 | |

FOREIGN PATENT DOCUMENTS

| | | | | |
|---|---|---|---|---|
| DE | 202005007077 | U1 | 8/2005 | |
| EP | 1697592 | B1 | 4/2007 | |
| WO | WO-2005052258 | A1 * | 6/2005 | E01B 11/18 |

* cited by examiner

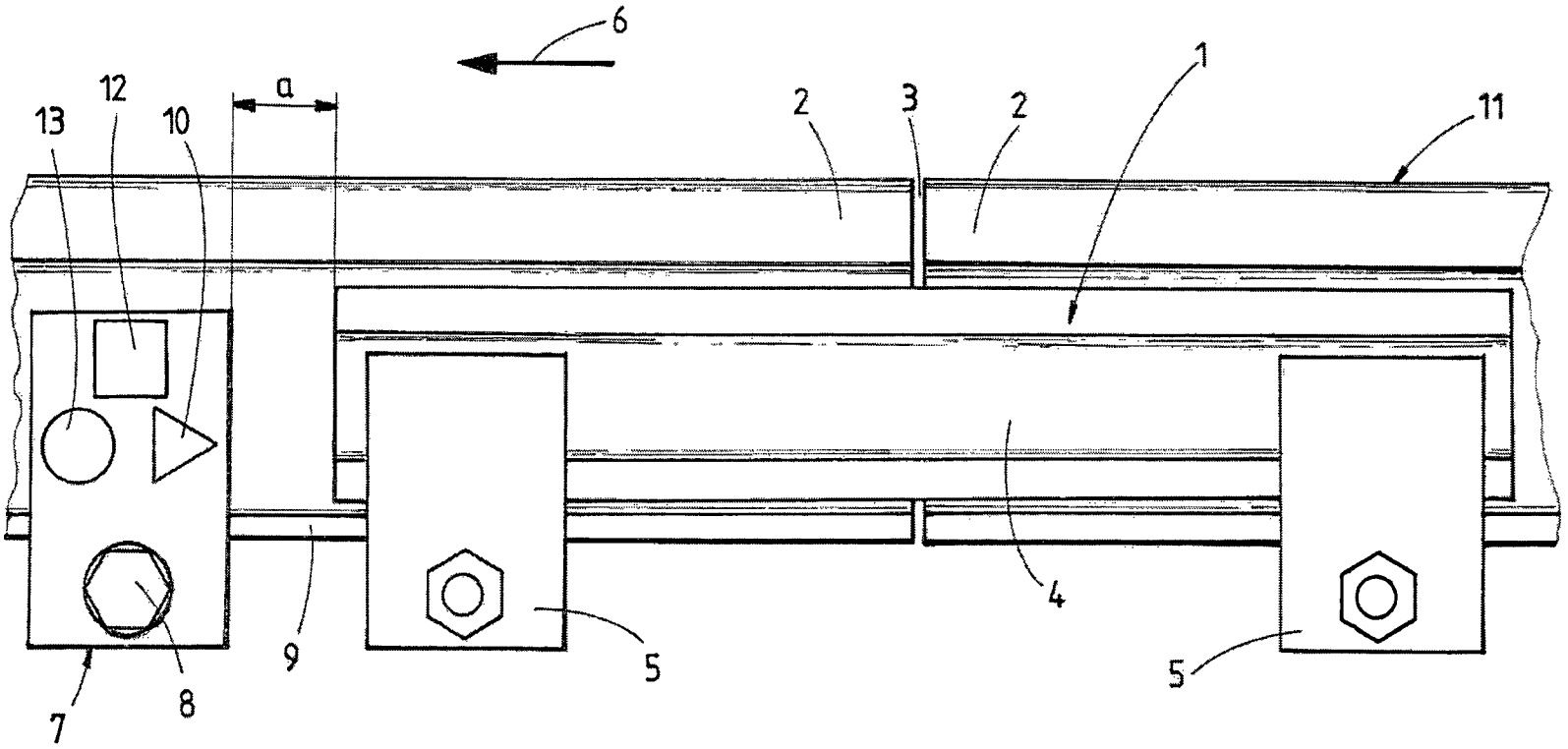
11
1
2
3
2
6
a
10
12
13
5
4
5
9
8
7

SAFEGUARDING SYSTEM FOR AN EMERGENCY FISH-PLATE CONNECTOR

BACKGROUND OF THE INVENTION

Field of the Invention

The invention relates to a safeguarding system for an emergency fish-plate connector which is provided for establishing a temporary connection of two successive rails of a track and is composed of a respective fish-plate arranged on each side of the corresponding rail and a clamping device pressing said fish-plates to the rail.

An emergency fish-plate connector of this kind is known from EP 1 697 592 and serves mainly as a temporary and quick-to-install aid in order to be able, after a rail fracture, to continue using the track with restricted travel speed. However, this emergency fish-plate connector must be checked by an operator at regular intervals in order to guarantee maximum safety.

SUMMARY OF THE INVENTION

It is the object of the present invention to provide a safeguarding system for an emergency fish-plate connector of the type mentioned at the beginning which renders repeated personal inspections unnecessary.

According to the invention, this object is achieved with a safeguarding system for an emergency fish-plate connector of the specified kind by way of the features cited in the characterizing part of the main claim.

With this combination of features, a reliable electronic surveillance of the functioning of the associated emergency fish-plate connector is ensured. In particular, it is possible to immediately register a dangerous displacement of the emergency fish-plate connector in the longitudinal direction of the rail. The measuring values of the safeguarding system, advantageously transmitted to a central control station, can be monitored there, possibly also in connection with further emergency fish-plate connectors, without the necessity to travel on the track for this purpose.

Additional advantages of the invention become apparent from the dependent claim and the drawing description.

The invention will be described in more detail below with reference to an embodiment represented in the drawing.

BRIEF DESCRIPTION OF THE DRAWING

The sole FIGURE of the drawing is a partial side view of two rails and a connecting fish-plate.

DESCRIPTION OF THE INVENTION

An emergency fish-plate connector 1 is provided for establishing a temporary connection of two successive rails 2 of a track 11 and comprises on each side of the rails 2 a fish-plate 4, bridging a rail gap 3, and clamping devices 5 pressing the fish-plates to the rails 2. Said clamping devices 5 are fixed with a pre-defined torque by screw connections, not further shown. (Details are known from DE 202005007077.7 U).

Adjoining the emergency fish-plate connector 1 with regard to a longitudinal direction 6 of the rail, a safeguarding system 7 is fastened by means of a screw connection 8 to a rail base 9 of the rail 2. Said safeguarding system 7—spaced from the emergency fish-plate connector 1 in the present embodiment—has a distance measuring device 10 for supplying a measuring value registering a distance a between the emergency fish-plate connector 1 and the safeguarding system 7.

For transmission of the detected measuring values and of an identifying signal—enabling a locally unambiguous correlation of the emergency fish-plate connector 1 with regard to the track 11—to a central control station (not shown) of a railway administration, the safeguarding system 7 is equipped with a radio device 12. Additionally, the safeguarding system 7 is equipped with an acceleration sensor 13 for recording measuring values registering vibrations.

The invention claimed is:

1. A safeguarding system for an emergency fish-plate connector for temporarily connecting two successive rails of a track, the emergency fish-plate connector including a respective fish-plate arranged on each side of the corresponding rail and a clamping device pressing the fish-plates onto the rail, the safeguarding system comprising:

a) a distance measuring device fastened to a rail base of the rail, said distance measuring device registering a distance a between the emergency fish-plate connector and the safeguarding system, and supplying a measuring value representing the distance a between the emergency fish-plate connector and the safeguarding system;

b) a radio device connected to said distance measuring device and configured for transmitting the detected measuring values and an identifying signal enabling a locally unambiguous correlation of the emergency fish-plate connector with regard to the track to a control station.

2. The safeguarding system according to claim 1, wherein the emergency fish-plate connector is spaced from the safeguarding system with regard to a longitudinal direction of the rail.

* * * * *